US005475186A

United States Patent [19]

Berlovan, Jr.

[11] Patent Number: 5,475,186

[45] Date of Patent: Dec. 12, 1995

[54] END FITTING WITH OPTIMIZED STRESS DISTRIBUTION

[75] Inventor: Viorel Berlovan, Jr., North Royalton, Ohio

[73] Assignee: Hubbell Incorporated, Orange, Conn.

[21] Appl. No.: 102,911

[22] Filed: Aug. 6, 1993

[51] Int. Cl.[6] ..... H01B 17/02; H01B 17/12

[52] U.S. Cl. ..... 174/176; 174/158 R; 174/182

[58] Field of Search ..... 174/176, 194, 174/195, 191–192, 141 R, 182, 180, 184, 185, 186, 188, 207, 208, 209, 210, 145, 150, 158 R, 160

[56] References Cited

U.S. PATENT DOCUMENTS

| | | | |
|---|---|---|---|
| 1,248,498 | 12/1917 | Jackson et al. | 174/150 |
| 1,426,789 | 8/1922 | Steinberger | 174/184 |
| 1,796,428 | 3/1931 | Austin | 174/150 |
| 3,272,463 | 9/1966 | Greig | 174/158 |
| 3,600,014 | 8/1971 | Harris | 174/176 |
| 3,898,372 | 8/1975 | Kalb | 174/179 |
| 4,303,799 | 12/1981 | Ishihara et al. | 174/176 |
| 4,343,966 | 8/1982 | Pargamin | 174/140 S |
| 4,610,033 | 9/1986 | Fox, Jr. | 455/612 |
| 4,883,930 | 11/1989 | Martin | 174/182 X |
| 5,220,134 | 6/1993 | Novel et al. | 174/179 |

*Primary Examiner*—Leo P. Picard
*Assistant Examiner*—Paramita Ghosh
*Attorney, Agent, or Firm*—Jerry M. Presson; David L. Tarnoff

[57] ABSTRACT

An end fitting with stress distribution for supporting an end of a device, such as an insulator, placed tension. The end fitting has a mounting hole for receiving a cylindrical mounting pin therethrough. The mounting hole has a pair of contacting points spaced laterally relative to the vector line of force to redirect the tensile load applied to the end fitting by a mounting pin located in the mounting hole. The end fitting is especially useful in insulators subjected to tensile loads.

23 Claims, 3 Drawing Sheets

END FITTING WITH OPTIMIZED STRESS DISTRIBUTION

FIELD OF THE INVENTION

The present invention relates to an end fitting or coupling member with stress distribution for supporting a device placed under tension by distributing the stress within the end fitting to increase tensile strength of the end fitting. More specifically, the invention relates to an end fitting having a mounting hole with a pair of pin contacting points spaced laterally relative to the vector line of force applied to the end fitting by a mounting pin located in the mounting hole. The mounting pin engages the contacting points to redirect the tensile load applied to the end fitting from the vector line of force to the two contact points which are laterally spaced from the vector line of force applied to the end fitting. The end fitting is especially useful in insulators subjected to tensile loads.

BACKGROUND OF THE INVENTION

Insulators are commonly employed for supporting high voltage electrical components and maintaining those components in a spaced relationship relative to other structures as well as the ground. Often such insulators are subjected to tensile stresses. For example, the insulator can be used as a hanger for supporting a transmission line with the insulator being suspended in tension between an arm of a tower and the transmission line. The insulator has a pair of end fittings for supporting and coupling the insulator to the support arm of the tower and to the transmission line.

As the voltage of the power transmission line increases, the length of the insulator supporting the transmission line must also be increased. Accordingly, insulators used with high voltage lines can be very long and heavy. This results in the end fittings being subjected to a large tensile stress or force, which requires the end fittings to be constructed as large, heavy duty members.

One example of an insulator is disclosed in U.S. Pat. No. 3,898,372 to Kalb. This insulator includes a central rod of insulating material, such as fiberglass. The ends of the rod include end fittings or coupling members for attaching the rod to transmission lines and to supporting structures. The central rod is surrounded by a series of weathersheds of a rubber-like polymeric material, for example, EPM. The weathersheds are placed end to end along the rod to form a long external surface path. A dielectric material fills spaces between the weathersheds and the insulator central rod to fill any voids between the rod and the weathersheds and to exclude contaminants and moisture which might otherwise form a conductive path.

Another example of an insulator is disclosed in U.S. Pat. No. 4,610,033 to Fox. This insulator has a pair of end fittings or coupling members for coupling the insulator between a support arm of a tower and a transmission line by a pair of shackles. The end fittings of this insulator are constructed of a metallic material.

Other examples of prior insulators with metallic end fittings are disclosed in U.S. Pat. No. 4,303,799 to Ishihara et al and U.S. Pat. No. 4,343,966 to Pargamin. The end fittings of these insulators have circular openings for coupling the insulators to supporting members.

In view of the above, it is apparent that a need exists for an insulator having end fittings or coupling members which reduce the stress within the end fittings to permit the end fittings to withstand higher tensile loads. This invention addresses this need in the art along with other needs which will become apparent to those skilled in the art once given this disclosure.

SUMMARY OF THE INVENTION

Accordingly, a primary object of the invention is to provide an insulator with at least one of its end fittings having a hole with an optimized inner diameter for redirecting the axial force vector.

Another object of the invention is to provide an insulator having at least one end fitting with reduced stress. A further object of the invention is to provide an insulator with at least one end fitting which is relatively inexpensive and simple to manufacture.

A further object of the invention is to provide an insulator with increased load strength without increased material.

The foregoing objects are basically attained by providing an insulator adapted to be placed under tension between a first supporting member and a second supporting member, comprising an elongated insulating member having a first end and a second end; a first end fitting coupled to the first end of the insulating member, and including a first coupling end for coupling the first end fitting to the first supporting member, the first coupling end having a first mounting pin for engaging the first supporting member, and a first mounting hole with a first pair of pin contacting points spaced laterally from a vector line of force applied to the first mounting pin for engaging the first mounting pin at two laterally spaced points; and a first end fitting coupled to the second end of the insulator member and including a second coupling end for coupling the second end fitting to the second support member.

The foregoing objects are also basically attained by providing an end fitting adapted to be placed under tension between a first supporting member and a second supporting member, comprising a first coupling member for coupling the end fitting to the first supporting member, the first coupling assembly having a first mounting pin for engaging the first support member and a first mounting hole with a first pair of pin contacting points spaced laterally from a vector line of force applied to the first mounting pin for engaging the first mounting pin at two laterally spaced points; and a second coupling member for coupling the end fitting to the second supporting member.

Other objects, advantages and salient features of the invention will become apparent from the following detailed description, which, taken in conjunction with the annexed drawings, discloses a preferred embodiment of the invention.

BRIEF DESCRIPTION OF THE DRAWINGS

Referring to the drawings which form part of this original disclosure.

DETAILED DESCRIPTION OF THE INVENTION

Figure 1:
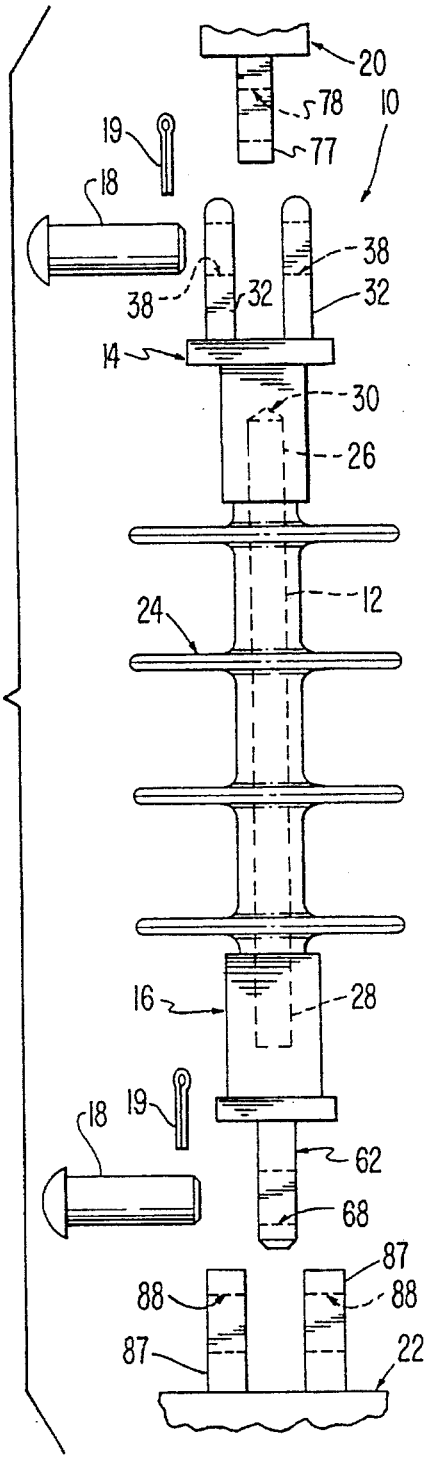
FIG. 1 is an exploded side elevational view of an insulator with end fittings and a pair of supporting or coupling members in accordance with the present invention.
Figure 2:
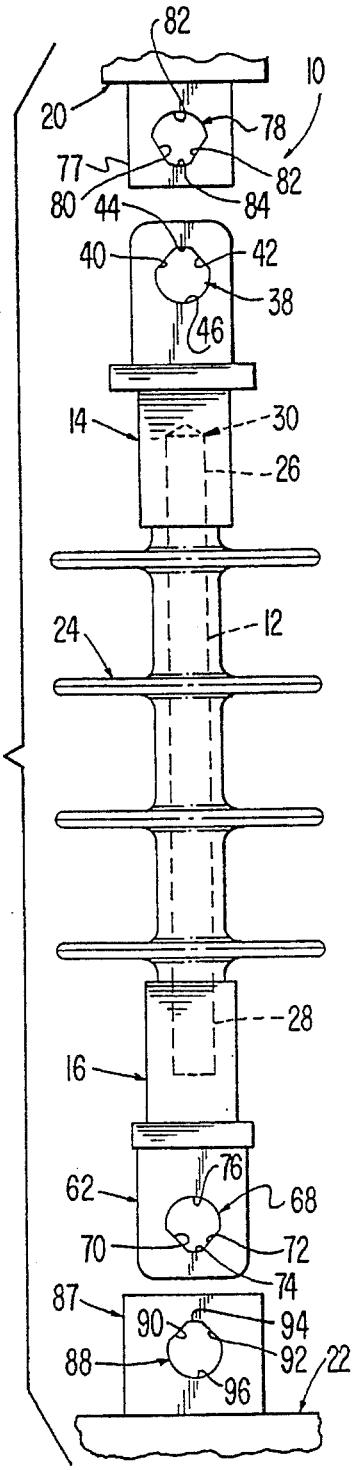
FIG. 2 is an exploded, side elevational view of the insulator and supporting or coupling members of FIG. 1 and a pair of supporting members.

Referring initially to FIGS. 1 and 2, an electrical assembly 10 according to the present invention is illustrated in the form of an insulator. Insulator 10 includes an insulating core member 12, a first end fitting or coupling member 14 rigidly coupled to the upper end of core member 12, a second end fitting or coupling member 16 rigidly coupled to the lower end of core member 12, a pair of metallic mounting pins 18 with cotter pins 19 for releasably coupling end fittings 14 and 16 to a pair of supporting members 20 and 22, and an elastomeric weathershed housing 24 overlying and enclosing the portion of core member 12 extending between end fittings 14 and 16.

Core member 12 is illustrated as an elongated cylindrical insulating rod, which is preferably composed of fiberglass reinforced epoxy, vinylester or polyester resin. Core member 12 can also be formed from other electrical components such as resisters, attesters, capacitors, or any combination thereof. Core member 12 as seen in FIG. 3, has a substantial uniform outer diameter with its upper and lower ends 26 and 28 fixedly coupled to end fittings 14 and 16 in a conventional manner, such as by crimping.

End fittings 14 and 16 are preferably metallic end fittings constructed of aluminum or forged AISI steel 1018 or any other suitable material. End fittings 14 and 16 are connected to core member 12 and weathershed housing 24 in substantially the same manner. Thus, only end fitting 14 will be illustrated and discussed in detail.

Figure 3:
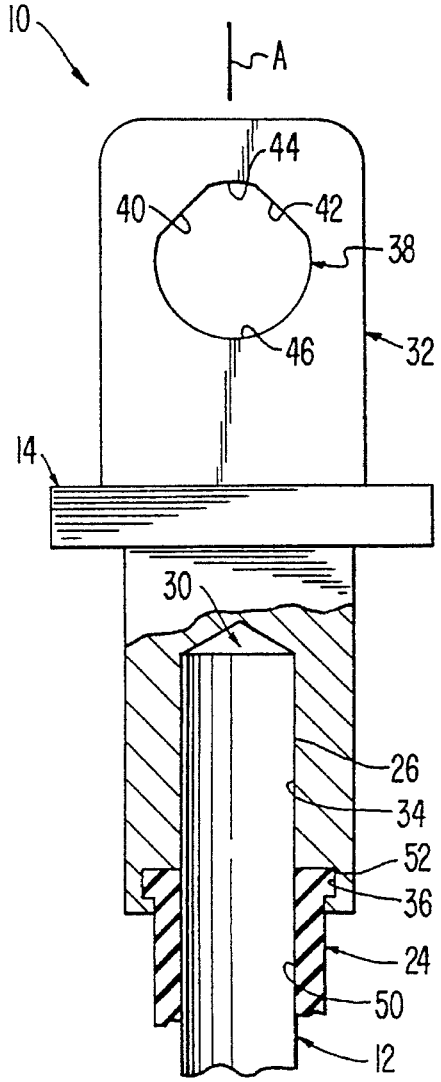
FIG. 3 is an enlarged, partial side elevational view of the insulator of FIGS. 1 and 2 with certain portions broken away.
Figure 4:
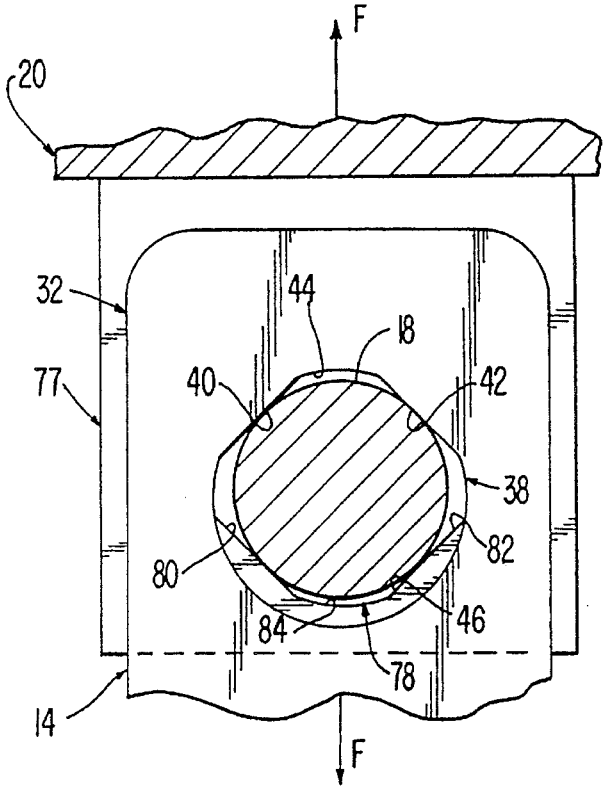
FIG. 4 is an enlarged, partial side elevational view of the end fitting of the insulator of FIGS. 1–3 coupled to one of the supporting or coupling members.

As seen in FIG. 3, end fitting 14 has an axially extending bore 30 at one end and a pair of longitudinally extending mounting flanges 32 at the other end. Bore 30 includes a first cylindrical portion 34 for receiving upper end 26 of core member 12 therein, and a second cylindrical portion 36 forming an annular groove for receiving a portion of weathershed housing 24 therein as discussed below.

Mounting flanges 32 are substantially identical and extend longitudinal from end fitting 14. Each mounting flange 32 has a mounting hole 38 for receiving one of the mounting pins 18 therein for releasably coupling end fitting 14 to first supporting member 20. Mounting flanges 32 are spaced apart from each other for receiving a portion of supporting member 20 therein.

Mounting hole 38 has a pair of flat contacting surfaces 40 and 42 converging towards the longitudinal axis of insulator 10, a first curved surface 44 extending between the converging ends of contacting surfaces 40 and 42, and a second curved surface 46 extending between the diverging ends of contacting surfaces 40 and 42.

Figure 5:
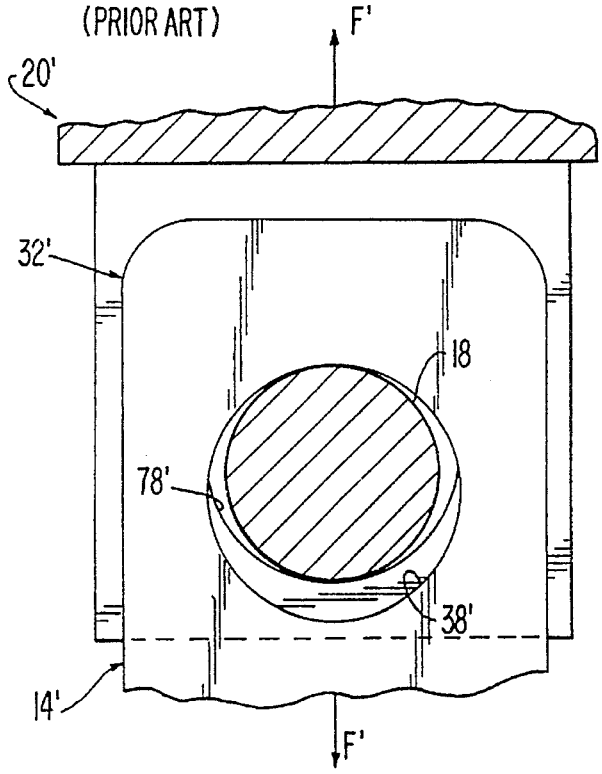
FIG. 5 (PRIOR ART)
FIG. 5 is an enlarged, partial side elevational view of a prior art end fitting of an insulator coupled to one end of a prior art supporting member.

Contacting surfaces 40 and 42 form angles between about 20° and about 65° with the longitudinal axis A of insulator 10. Preferably, contacting surfaces 40 and 42 are each angled approximately 45° with the longitudinal axis of insulator 10. Contacting surfaces 40 and 42 form two laterally spaced contacting points for tangentially engaging mounting pin 18 and for redirecting the axial force F applied to end fitting 14 by pin 18 to the two laterally spaced contacting points of contacting surfaces 40 and 42. Accordingly, the vector line of force F applied along the longitudinal axis A of insulator 10 is redirected laterally within the end fitting 14 to the contacting points of contacting surfaces 40 and 42 for reducing the magnitude of the force within the end fitting 14 by providing a more evenly distribution of stress within end fitting 14. In other words, contacting surfaces 40 and 42 tangentially engage mounting pin 18 at two points instead of one point as in the prior art end fitting 14'. Accordingly, mounting pin 18 does not engage first curved surface 44 at the point of the longitudinal axis of insulator 10. Since the amount of stress in end fitting is not concentrated at one point along the longitudinal axis of insulator 10, end fitting 14 can be made of less material, and still have the same or more strength than the prior art end fitting 14' with a circular opening 38' as shown in FIG. 5.

First curved surface 44 and second curved surface 46 lie on a circle with a common center point with contacting surfaces 40 and 42 being secants of the circle. Preferably, first curved surface 44 forms an arc extending approximately 40°, while second curved surface 46 forms an arc on the circle of about 220°.

Weathershed housing 24 has an axially extending bore 50 for receiving core member 12 therein. Specifically, bore 50 has a substantially uniform cylindrical inner diameter which is smaller than or equal to the diameter of core member 12 when its unstressed state. The interface between bore 50 and core member 12 can be coated with a viscous insulating material, such as silicone grease to prevent the ingress of contaminants along the surface of core member 12 and bore 50 of weathershed housing 24. Alternatively, bore 50 can have a series of annular grooves filled with a viscous insulating material as disclosed in U.S. Pat. No. 3,898,372 to Kalb, which is incorporated herein by reference. Weathershed housing 24 is preferably composed of a polymeric, elastomeric material having sufficient resiliency to expand radially outwardly upon insertion of core member 12 into axially extending bore 50. The upper end of weathershed housing 18 has an annular flange 52 which is received in second cylindrical portion 36 of end fitting 14.

As seen in FIGS. 1 and 2, lower end fitting 16 has a bore 60 at one end for receiving portions of core member 12 and weathershed housing 24 therein, and a mounting flange 62 at its other end for releasably coupling the lower end of insulator 10 to second supporting member 22 via one of the mounting pins 18. Bore 60 of lower end fitting 16 is substantially identical to bore 30 of upper end fitting 14, and thus will not be discussed or illustrated in detail.

As seen in FIG. 2, mounting flange 62 has a mounting hole 68 with a pair of contacting surfaces 70 and 72, a first curved portion 74 extending between the converging ends of contacting surfaces 40 and 42, and a second curved portion 76 extending between the diverging ends of contacting surfaces 40 and 42. Mounting hole 68 is substantially identical to mounting hole 38 and engages mounting pin 18 in substantially the same manner. Thus, mounting hole 68 will not be discussed or illustrated in detail herein.

First supporting member 20 is preferably coupled to a support arm of an electrical tower (not shown) in a conventional manner. Supporting member 20 has a mounting flange 77 with a mounting hole 78 for receiving mounting pin 18 therethrough for coupling the upper end of insulator 10 thereto.

Mounting hole 78 has a pair of flat contacting surfaces 80 and 82 converging towards the longitudinal axis of insulator 10, a first curved surface 84 extending between the first or close end of contacting surfaces 80 and 82, and a second curved surface 86 extending between the second ends of contacting surfaces 80 and 82.

Contacting surfaces 80 and 82 are positioned to form angles ranging between about 20° and about 65° with the vector line of force applied to pin 18 when mounted in mounting hole 78. Preferably, contacting surfaces 80 and 82 are each angled approximately 45° with the longitudinal axis of insulator 10. Contacting surfaces 80 and 82 form two laterally spaced contacting points for tangentially engaging mounting pin 18 and for redirecting the axial force F applied to supporting member 20 by pin 18 to the two laterally spaced contacting points. Accordingly, the vector line of force F applied to insulator 10 and directed along the longitudinal axis A of insulator 10 is redirected laterally to the two contacting points for reducing the magnitude of the force distributed within the supporting member 20 by more evenly distributing the stress therein.

First curved surface 84 and second curved surface 86 lie on a circle with a common center point with contacting surfaces 80 and 82 being secant of the circle. Preferably, first curved surface 84 forms an arc extending approximately 40°, while second curved surface 46 forms an arc on the circle of about 220°.

Second supporting member 22 is preferably coupled to an electrical device or power line (not shown) in a conventional manner. Supporting member 22 has a pair of mounting flanges 87 spaced laterally apart for receiving mounting flange 52 of lower end fitting 16 therebetween. Mounting flanges 87 each have a mounting hole 88 therein for receiving one of the mounting pins 18 therethrough for connecting lower end fitting 16 thereto.

Mounting hole 88 has a pair of flat contacting surfaces 90 and 92 converging towards the longitudinal axis of insulator 10, a first curved surface 94 extending between the first or close end of contacting surfaces 90 and 92, and a second curved surface 96 extending between the second ends of contacting surfaces 90 and 92.

Contacting surfaces 90 and 92 form angles ranging between about 20° and about 65° with the vector line of force applied to 18 and transmitted thereto. Preferably, contacting surfaces 90 and 92 are each angled approximately 45° with the vector line of force applied to 18 and transmitted thereto. Contacting surfaces 90 and 92 form two laterally spaced contacting points for tangentially engaging mounting pin 18 and for redirecting the axial force F applied to supporting member 22 by pin 18 to the two laterally spaced contacting points. Accordingly, the vector line of force which is applied to insulator 109 and transmitted to supporting member 22 along the longitudinal axis of insulator 10 is redirected laterally to the two contacting points for reducing the magnitude of the force distributed within supporting member 22 by more evenly distributing the stress therein.

First curved surface 94 and second curved surface 96 lie on a circle with a common center point with contacting surfaces 90 and 92 being secant of the circle. Preferably, first curved surface 94 forms an arc extending approximately 40°, while second curved surface 96 forms an arc on the circle of about 220°.

It will be apparent to those skilled in the art that insulator 10 can be used with a conventional supporting member 20' with a circular mounting hole 78', and that end fittings 14 and 16 and coupling members 20 and 22 can be used with other devices or members which are subjected to a tensile force. For example, end fitting 14 and 16 could be used as end coupling members of a cable or chain.

Example

Figure 6:
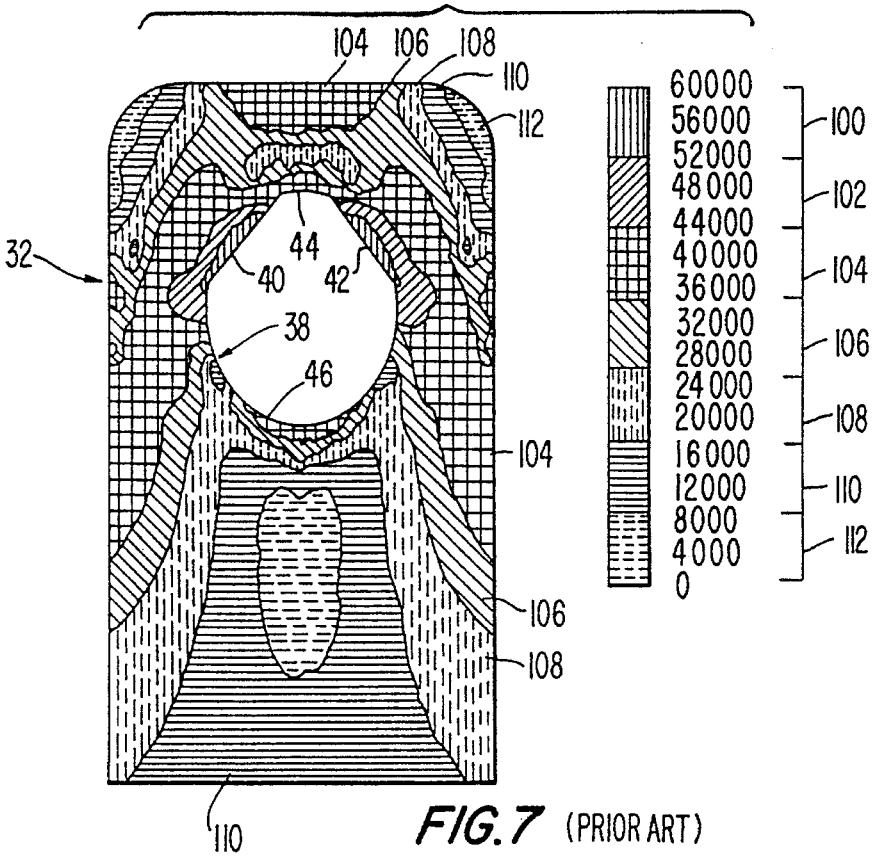
FIG. 6 is a computerized printout of the stress distribution of the stress applied to an end fitting of an insulator constructed in accordance with the present invention.
Figure 7:
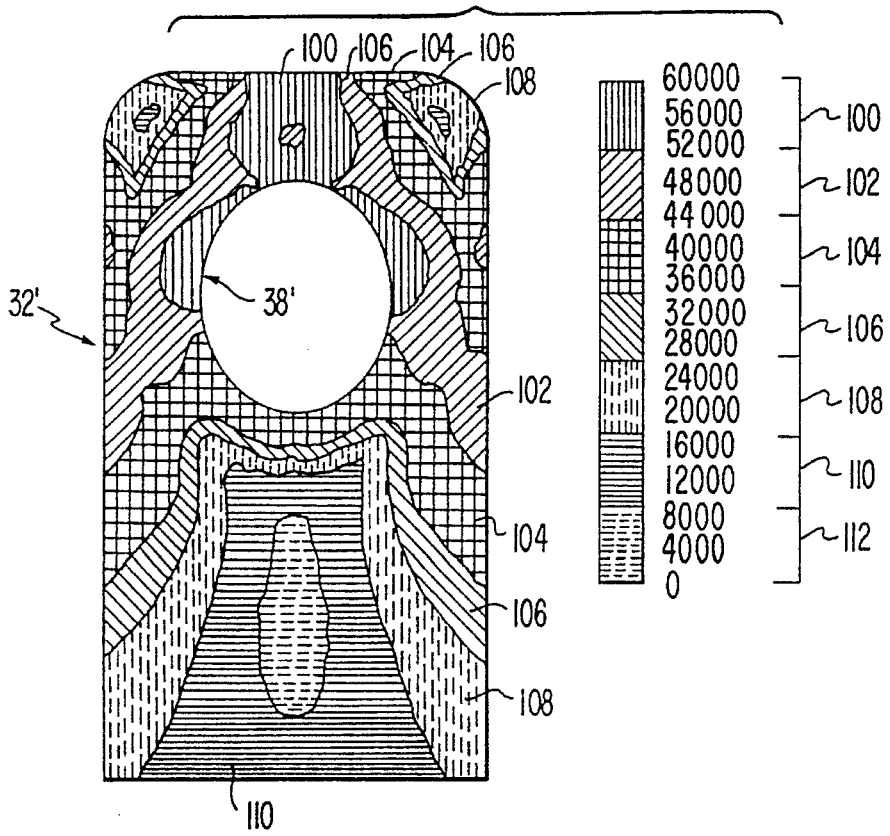
FIG. 7 (PRIOR ART)
FIG. 7 is a computer printout of the stress distribution of a tensile load or stress applied to a prior art end fitting with a circular opening.

Referring now to FIGS. 6 and 7, computer printouts are illustrated showing stress distribution within the end fittings during the two tests which were conducted, one on an end fitting constructed according to the present invention, and another on an end fitting using a substantially circular hole as shown in FIG. 5.

The two computer printouts of FIGS. 6 and 7 illustrate the stress distribution within end fittings 14 and 14' according to seven levels or ranges of stress. The highest or first level of stress 100 ranges from 60,000 p.s.i. to 52,000 p.s.i. The next or second level of stress 102 ranges from 52,000 p.s.i. to 44,000 p.s.i. The third level of stress 104 ranges from 44,000 p.s.i. to 36,000 p.s.i. The fourth level of stress 106 ranges from 36,000 p.s.i to 28,000 p.s.i. The fifth level of stress 108 ranges from 24,000 p.s.i. to 16,000 p.s.i. The sixth level of stress 110 ranges from 16,000 p.s.i to 8,000 p.s.i. The seventh level of stress 112 ranges from 8,000 p.s.i to 0. The above stress were obtained by the Von Mises criteria.

Mounting hole of end fitting 14 was milled, while the end fitting 14' was casted with a circular opening 38' in an end flange 32'. Each of the end fitting was constructed of forged AISI 1018 steel. During the tests, a tensile force was applied to each of the end fittings 14 and 14'. As seen in FIG. 6, the highest stress areas 100 of (depicted in red by the computer printout) of end fitting are located along pin contacting surfaces 40 and 42. The highest stress areas 100' (also depicted in red by the computer printout) of end fitting 14' are located along the vector line of force as seen in FIG. 7. Also, the highest stress area 100' of end fitting 14' is substantially larger than the highest stress area 100 of end fitting. Moreover, the stress throughout end fitting 14 is more evenly distributed at a lower stress level then end fitting 14'.

While only one embodiment has been chosen to illustrate the invention, it will be understood by those skilled in the art that various changes and modifications can be made herein without departing from the scope of the invention as defined in the appended claims.

What is claimed is:

1. An insulator adapted to be placed under tension between a first supporting member and a second supporting member, comprising:

an elongated insulating member having a first end and a second end;

a first end fitting having a first fixed end coupled to said first end of said insulating member, a first substantially free end spaced from said first fixed end and first coupling means for coupling said first end fitting to the first supporting member, said first coupling means having a first mounting pin for engaging the first supporting member, and a first mounting hole having a first pair of pin contacting surfaces spaced laterally from a vector line of force applied to said first mounting pin for engaging said first mounting pin at two laterally spaced points, a first connecting surface being located adjacent said first free end and extending between first ends of said first pair of pin contacting surfaces, and a second connecting surface extending between second ends of said first pair of pin contacting surfaces and being located between said first connecting surface and said first fixed end, said first connecting surface being positioned and shaped to avoid contact with said first mounting pin for reducing stress within said first end fitting between said first connecting surface and said first free end; and a second end fitting having a second fixed end coupled to said second end of said insulating member, a second substantially free end spaced from said fixed end and second coupling means for coupling said second end fitting to the second supporting member.

2. An insulator adapted to be placed under tension between a first supporting member and a second supporting member, comprising:

an elongated insulating member having a first end and a second end;

a first end fitting having a first fixed end coupled to said first end of said insulating member, a first substantially free end spaced from said first fixed end and first coupling means for coupling said first end fitting to the first supporting member, said first coupling means having a first mounting pin for engaging the first supporting member, and a first mounting hole having a first pair of pin contacting surfaces spaced laterally from a vector line of force applied to said first mounting pin for engaging said first mounting pin at two laterally spaced points, a first connecting surface extending between first ends of said first pair of pin contacting surfaces, and a second connecting surface extending between second ends of said first pair of pin contacting surfaces, said first connecting surface being positioned and shaped to avoid contact with said first mounting pin for reducing stress within said first end fitting between said first connecting surface and said first free end; and a second end fitting having a second fixed end coupled to said second end of said insulating member, a second substantially free end spaced from said fixed end and second coupling means for coupling said second end fitting to the second supporting member, said first pair of pin contacting surfaces being formed by a pair of flat converging with surfaces with said first ends of said pin contacting surfaces converging toward each other and said second ends of said pin contacting surfaces diverging away from each other.

3. An insulator according to claim 2, wherein each of said converging surfaces form an angle with the vector line of force ranging from approximately 20° to approximately 65°.

4. An insulator according to claim 2, wherein each of said converging surfaces form approximately a 45° angle with the vector line of force.

5. An insulator according to claim 2, wherein said first connecting surface includes a first curved portion extending between said first converging ends of said pair of flat converging surfaces.

6. An insulator according to claim 5, wherein said first curved connecting surface forms an arc extending approximately 40° between said first converging ends of said pair of flat converging surfaces.

7. An insulator according to claim 5, wherein said second connecting surface includes a curved portion extending between said second diverging ends of said pair of flat converging surfaces.

8. An insulator according to claim 7, wherein said first and second curved portions form arcs of a circle with a common center point and extend contiguously from said pair of flat converging surfaces.

9. An insulator according to claim 7, wherein said second curved portion forms an arc extending approximately 220°.

10. An insulator according to claim 1, wherein said second coupling means includes a second mounting pin for engaging the second supporting member, and a second mounting hole having a second pair of pin contacting surfaces spaced laterally from a vector line of force applied to said second mounting pin, a third connecting surface being located adjacent said second free end and extending between first ends of said second pair of pin contacting surfaces, and a fourth connecting surfaces extending between second ends of said second pair of pin contacting surface and being located between said third connecting surface and said second fixed end, said second connecting surface being positioned and shaped to avoid contact with said second mounting pin for reducing stress within said second end fitting between said third connecting surface and said second free end.

11. An insulator adapted to be placed under tension between a first supporting member and a second supporting member, comprising:

an elongated insulating member having a first end and a second end;

a first end fitting having a first fixed end coupled to said first end of said insulating member, a first substantially free end spaced from said first fixed end and first coupling means for coupling said first end fitting to the first supporting member, said first coupling means having a first mounting pin for engaging the first supporting member, and a first mounting hole having a first pair of pin contacting surfaces spaced laterally from a vector line of force applied to said first mounting pin for engaging said first mounting pin at two laterally spaced points, a first connecting surface extending between first ends of said first pair of pin contacting surfaces, and a second connecting surface extending between second ends of said first pair of pin contacting surfaces, said first connecting surface being positioned and shaped to avoid contact with said first mounting pin for reducing stress within said first end fitting between said first connecting surface and said first free end; and a second end fitting having a second fixed end coupled to said second end of said insulating member, a second substantially free end spaced from said fixed end and second coupling means for coupling said second end fitting to the second supporting member, said second coupling means including a second mounting pin for engaging the second supporting member, and a second mounting hole having a second pair of pin contacting surfaces spaced laterally from a vector line of force applied to said second mounting pin, a third connecting surface extending between first ends of said second pair of pin contacting surfaces, and a fourth connecting surfaces extending between second ends of said second pair of pin contacting surface, said second connecting surface being positioned and shaped to avoid contact with said second mounting pin for reducing stress within said second end fitting between said third connecting surface and said second free end, said first pair of pin contacting surfaces being formed by a first pair of flat converging surfaces with said first ends of said first pair of pin contacting surfaces converging towards each other and said second ends of said first pair of pin contacting surfaces diverging away from each other, and said second pair of pin contacting surfaces being formed by a second pair of flat converging surfaces with said first ends of said second pair of pin contacting surfaces converging towards each other and said second ends of said second pair of pin contacting surfaces diverging away from each other.

12. An insulator according to claim 11, wherein each of said converging surfaces form an angle with the vector line of force ranging from approximately 20° to approximately 65°.

13. An insulator according to claim 11, wherein each of said converging surfaces form approximately a 45° angle with the vector line of force.

14. An insulator according to claim 11, wherein each of said first and third connecting surfaces includes a first curved portion extending between said first converging ends of said first and second pair of flat converging surfaces, respectively.

15. An insulator according to claim 14, wherein each of said first curved portions form an arc extending approximately 40°.

16. An insulator according to claim 14, wherein each of said second and fourth connecting surfaces includes a second curved portion extending between said second diverging ends of said first and second pair of flat converging surfaces, respectively.

17. An insulator adapted to be placed under tension between a first supporting member and a second supporting member, comprising:

an elongated insulating member having a first end and a second end;

a first end fitting having a first fixed end coupled to said first end of said insulating member, a first substantially free end and first coupling means for coupling said first end fitting to the first supporting member, said first coupling means having a first mounting pin for engaging the first supporting member, and a first mounting hole formed within said first free end, and having a first pair of flat converging surfaces for engaging said first mounting pin, a first non-contacting curved surface extending between one of the ends of said first pair of flat converging surfaces, and a second non-contacting surface extending between the other ends of said first pair of flat converging surfaces, said first non-contacting surface being positioned and shaped to avoid contact with said first mounting pin for reducing stress within said first free end of said first end fitting such that no force is directly transmitted to said first non-contacting surface by contact with said first mounting pin; and a second end fitting having a second fixed end coupled to said second end of said insulating member, a second substantially free end and second coupling means for coupling said second end fitting to the second supporting member, said second coupling means having a second mounting pin for engaging the second supporting member, and a first mounting hole formed within said second free end, and having a second pair flat converging surfaces for engaging said second mounting pin, a third non-contacting surface extending between one of the ends of said second pair of flat converging surfaces, and a fourth non-contacting curved surface extending between the other ends of said second pair of flat converging surfaces, said third non-contacting surface being positioned and shaped to avoid contact with said second mounting pin for reducing stress within said second free end of said second end fitting such that no force is directly transmitted to said third non-contacting surface by contact with said second mounting pin.

18. An insulator according to claim 17, wherein said first and third non-contacting curved surfaces form arcs extending approximately 40°.

19. An end fitting adapted to be placed under tension between a first supporting member and a second supporting member, comprising:

first coupling means for coupling said end fitting to the first supporting member, said first coupling means having a first mounting pin for engaging the first supporting member, and a first mounting hole including a first pair of pin contacting surfaces spaced laterally from a vector line of force applied to said first mounting pin for engaging said first mounting pin at two laterally spaced points, a first connecting surface extending between first ends of said first pair of pin contacting surfaces, and a second connecting surface extending between said second ends of said first pair of pin contacting surfaces, said first connecting surface being positioned and shaped to avoid contact with said first mounting pin for reducing stress within said first end fitting by avoiding contact between said first mounting pin and said first connecting surface; and second coupling means for coupling said end fitting to the second supporting member, said first pair of pin contacting surfaces being formed by a pair of flat converging surfaces having said first ends converging towards each other and said second ends diverging away from each other.

20. An end fitting according to claim 19, wherein each of said converging surfaces form an angle with the vector line of force ranging from approximately 20° to approximately 65°.

21. An end fitting according to claim 19, wherein each of said converging surfaces form approximately a 45° angle with the vector line of force.

22. An end fitting according to claim 19, wherein said first connecting surfaces includes a first curved surface extending between said first converging ends of said pair of flat converging surfaces.

23. An end fitting according to claim 22, wherein said first curved surface forms an arc extending approximately 40°.

* * * * *